US006505638B1

(12) United States Patent
Powell et al.

(10) Patent No.: US 6,505,638 B1
(45) Date of Patent: Jan. 14, 2003

(54) CANOPY STRUCTURE

(76) Inventors: Billy R. Powell, 4808 Tannen Hill Trail, Holly Springs, NC (US) 27540; Toney A. Powell, 4008 Ridgebrook Bluffs Dr., Raleigh, NC (US) 27603; David R. Powell, 7309 Rouse Rd., Holly Springs, NC (US) 27540

( * ) Notice: Subject to any disclaimer, the term of this patent is extended or adjusted under 35 U.S.C. 154(b) by 0 days.

(21) Appl. No.: 10/040,551

(22) Filed: Jan. 7, 2002

Related U.S. Application Data

(62) Division of application No. 09/657,712, filed on Sep. 8, 2000, now Pat. No. 6,367,495, which is a division of application No. 09/234,746, filed on Jan. 21, 1999, now Pat. No. 6,155,280.

(51) Int. Cl.[7] ..... E04H 15/54

(52) U.S. Cl. ..... 135/124; 135/115; 135/119; 135/907; 135/120.9; 52/83; 52/23

(58) Field of Search ..... 135/124, 121, 135/122, 115, 120.4, 906, 119; 52/23, 83

(56) References Cited

U.S. PATENT DOCUMENTS 1,884,449 A * 10/1932 Wickstrum ..... 135/138
1,900,335 A * 3/1933 Vecchio ..... 135/906
2,144,747 A * 2/1939 Adams ..... 135/138
2,151,908 A * 3/1939 Gottlies ..... 135/906
2,513,729 A * 7/1950 Lemen ..... 135/115
2,835,262 A * 5/1958 Collins ..... 135/144
3,590,864 A * 7/1971 Vechesloff ..... 135/115 X
3,766,573 A * 10/1973 Burkholz et al. ..... 135/115 X
4,471,794 A * 9/1984 Kirkham, Jr. ..... 135/95
4,641,676 A * 2/1987 Lynch ..... 135/115 X
5,117,853 A * 6/1992 Pruesner ..... 135/121
5,224,507 A * 7/1993 Vosse ..... 135/115 X
5,531,418 A * 7/1996 Lindgren ..... 135/120.4 X
5,560,384 A * 10/1996 Oh ..... 135/115
5,638,851 A * 6/1997 Baldwin ..... 135/124
5,711,337 A * 1/1998 McKenney ..... 135/121
5,730,281 A * 3/1998 Powell et al. ..... 135/136 X
5,771,912 A * 6/1998 Swetish ..... 135/120.4 X
6,145,526 A * 11/2000 Quiring et al. ..... 135/115 X

* cited by examiner

*Primary Examiner*—Lanna Mai
*Assistant Examiner*—Winnie Yip
(74) *Attorney, Agent, or Firm*—Coats & Bennett, P.L.L.C.

(57) ABSTRACT

The canopy structure of the present invention includes a generally rigid internal frame structure comprised of light-weight metal tubes and a pliable, waterproof covering such as nylon or other functionally similar fabric. The canopy covering further includes a series of grommet reinforced securing points which are each adapted to receive a tie-down or securing cord. These securing cords are formed of a loop of elastic or shock cord material which is attached to a ball-shaped stopper. Threaded into the edges of the canopy end panels are a pair of elastic bolt cords which also incorporate ball-shaped stoppers at both ends. The canopy covering is stretched taughtly across the top of the frame structure and attached to individual horizontal frame members using the elastic securing cords. Grommets located along the sides of the covering are attached to individual vertical frame members using both the elastic securing cords and an associated securing or locking tab. The elastic bolt cords associated with the ends of the covering are also attached to individual vertical frame members using the locking tabs.

11 Claims, 8 Drawing Sheets

CANOPY STRUCTURE

CROSS-REFERENCE TO RELATED APPLICATION

This is a divisional application of U.S. patent application Ser. No. 09/657,712, filed Sep. 8, 2000 now U.S. Pat. No. 6,367,495 which was a divisional application of U.S. patent application Ser. No. 09/234,746, filed Jan. 21, 1999 and now U.S. Pat. No. 6,155,280.

FIELD OF THE INVENTION

The present invention relates to elevated canopy structures, and more particularly to an elevated canopy structure which includes an internal frame and an outer fabric covering which is generally secured to the frame using a series elastic securing cords.

BACKGROUND OF THE INVENTION

It is often desirable to park or store vehicles, such as automobiles and boats, in a covered or sheltered environment so as to prevent damage and wear caused by long term exposure to the natural elements. While conventional wooden or brick garages and car ports provide the desired shelter, such structures are generally quite expensive. In fact, it is often the case that construction of such a conventional garage structure costs as much or more than the vehicle that it is intended to protect.

As an alternative to such conventional garage structures, relatively inexpensive and light-weight canopy-type structures are often employed. These canopy structures are typically comprised of a light-weight internal frame and an outer covering or canopy. In general, such canopy structures provide complete or full overhead protection, while providing only part-length side wall panels. Such part-length side walls provide some degree of protection from the sun and rain, however, they often perform poorly in windy conditions. That is, these side wall panels generally extend downward and hang freely from the overhead panel and, as such, are easily moved and flopped by the wind. In light wind conditions, such movement tends to reduce the overall effectiveness of the flaps, as rain and sun are periodically allowed to pass unobstructed into the interior or protected region of the canopy. Furthermore, in high wind conditions, the movement of the side panel flaps may actually lead to them being damaged.

Therefore there is and continues to be a need for a light-weight and relatively inexpensive protective canopy structure, that includes partial side wall panels which are generally secured to the supporting internal frame structure.

SUMMARY OF THE INVENTION

The present invention relates to a canopy structure that includes a main frame and a pliable cover supported over the main frame. There is provided a series of tie cords that secure the cover to the main frame. Further there is provided a series of securing tabs that are mounted on the main frame and which are attachable to the tie cords for effectively interconnecting the pliable cover to the main frame of the canopy. Each of the securing tabs is movably mounted on the frame structure such that the securing tabs can be moved from one point to another on the frame structure but wherein the respective tabs in response to a force being applied assumes a binding position on the main frame and thus effectively holds the securing tab in a generally stationary position on the main frame and that in turn securely holds the pliable cover to the main frame.

In another embodiment of the present invention, the canopy structure is provided with at least one turn down end panel that is secured across the front or rear end of the canopy structure such that it basically depends downwardly from the upper portion of the frame structure that supports the canopy. In particular, the pliable cover that forms a part of the canopy structure includes an end section that extends transversally across the upper portion of the canopy structure as a whole. A tie cord is attached to the end panel and functions to hold the end panel in a generally taunt position as it spans an end area of the canopy structure.

In another embodiment of the present invention, the canopy structure of the present invention includes a frame network that is specifically designed to minimize the number of different parts or components that go into making up the frame structure as a whole. In this regard, the frame structure includes a series of pipe members that form various parts of the overall frame structure. These pipe members are required to be interconnected together. Therefore, the canopy frame structure is provided with a series of interconnectors and these interconnectors generally include a series pipe fingers or arms that radiate from a central area of the connector. In this embodiment of the present invention, there are only two different pipe interconnectors. That is, in order to connect any two pipes of the frame structure together, the personnel actually erecting the frame structure will only have to select from two different pipe interconnectors.

It is therefore an object of the present invention to provide a canopy structure of the character referred to above that can be easily installed.

Another object of the present invention is to provide a canopy structure that includes an adjustable structure for tying down one or more side flaps that may form a part of the pliable cover of the canopy structure.

Another objection of the present invention resides in the provision of a frame structure or frame network for a canopy structure of the type referred to above, wherein the frame structure components are designed so as to minimize the number of interconnectors used to interconnect various frame members.

Other objects and advantages of the present invention will become apparent and obvious from a study of the following description and the accompanying drawings, which are merely illustrative of such invention.

DETAILED DESCRIPTION OF THE INVENTION

Figure 1:
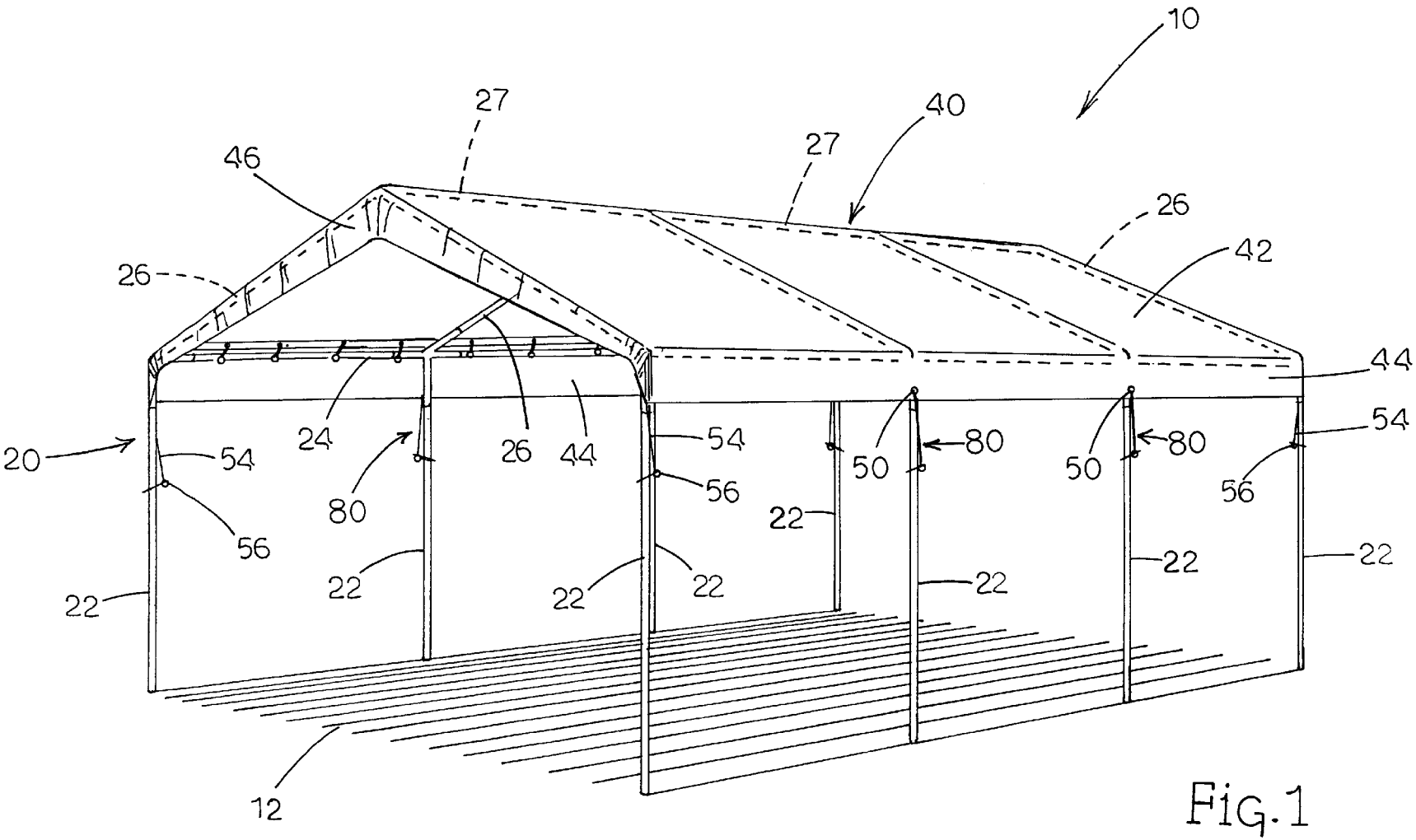
FIG. 1 is a perspective view of the canopy structure of the present invention which incorporates a linear or straight-pitched roof design.

Shown in FIG. 1 is a canopy-type garage or car-port structure of the present invention, which is generally indicated by the numeral 10. Canopy structure 10 includes an internal frame assembly, generally indicated by the numeral 20, which is further comprised of a series of vertical support members 22, horizontal support members 24, angled roof or truss support members 26, and horizontal ridge members 27. In the preferred embodiment described herein, these structural support members are fabricated of a relatively lightweight aluminum alloy or other metal, and are in the form of hollow tubes or pipes. When completely assembled, the various vertical, horizontal, and roof truss support members 22, 24, and 26, respectively, are joined and linked together using a number of connectors 28 (FIG. 8) so as to form the structurally sound and stable internal frame assembly 20 shown in FIG. 1. In general, connectors 28 are fabricated of a metal or suitably strong plastic polymer, and include a number of hollow projections or arms, which are oriented at various angles to one another. The hollow arms of each connector 28 are adapted to receive and generally secure the structural support members that are inserted therein. See FIGS. 2A and 8

It will be appreciated that the vertical support members 22, in a fully assembled frame structure 20, are generally disposed such that one end of each vertical member 22 is buried just below the surface of a relatively level area of ground 12. In practice, the buried ends of the vertical members 22 may be additionally set in concrete or cement so as to further secure and stabilize the entire frame assembly 20.

With particular regard to the roof truss members 26, it will be appreciated that the shape of these truss members is responsible for determining the general contour of the canopy roof line. As the truss members 26 shown in FIG. 1 are generally straight lengths of metal tubing, the corresponding contour of the roof line is generally linear or V-shaped, when viewed from either end of the canopy structure 10. However, an alternate embodiment of the canopy structure shown in FIGS. 2 and 2A includes a series of generally curved or arched truss members 26. Consequently, the roof line of this structure 10, when viewed from either end is generally arched so as to give the canopy structure a different aesthetic or gothic appearance. In all other functional respects, the frame structure 20 illustrated in FIG. 2 is generally similar to the frame structure 20 that is presented in FIG. 1 and described above.

Figure 2:
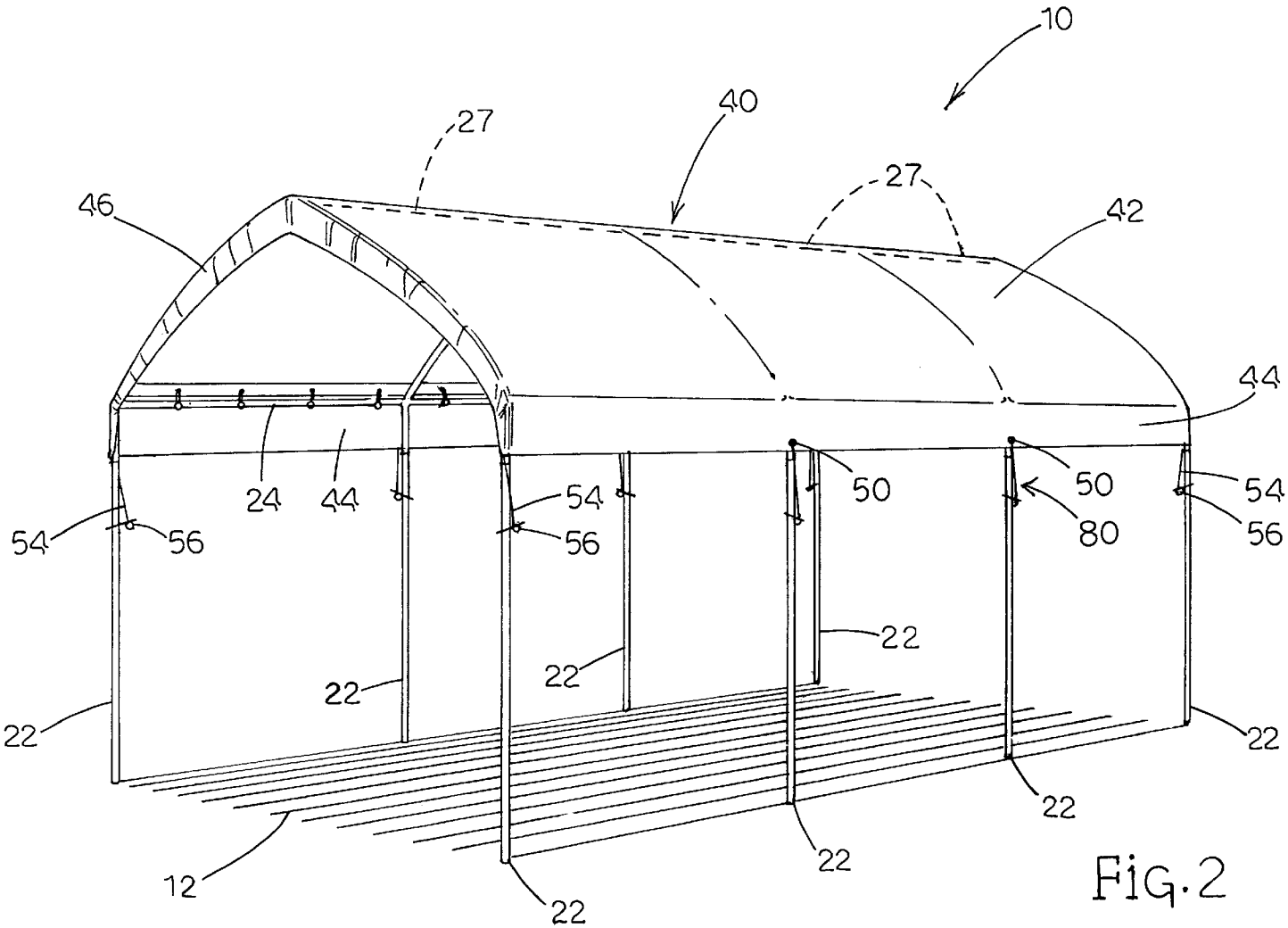
FIG. 2 is a perspective view of the canopy structure of the present invention which incorporates an arched or curve-pitched roof design.

Canopy structure 10 also includes a canopy covering which is generally indicated by the numeral 40, as shown in FIGS. 1 and 2. Covering 40 is comprised of a top or roof panel 42, a pair of side panels 44, and a pair of end panels 46. In the preferred embodiment disclosed and discussed herein, the canopy covering 40 is fabricated of a generally waterproof material such as water sealed nylon or the like. It will be appreciated that a variety of covering materials may be employed to provide the required protection, including woven fabrics which are comprised of synthetic and/or natural fibers, as well as plastics such as polypropylene and the like. So long as the covering material provides sufficient protection from the natural elements, the choice of a specific covering material will be mainly driven by cost and durability issues.

Figure 3:
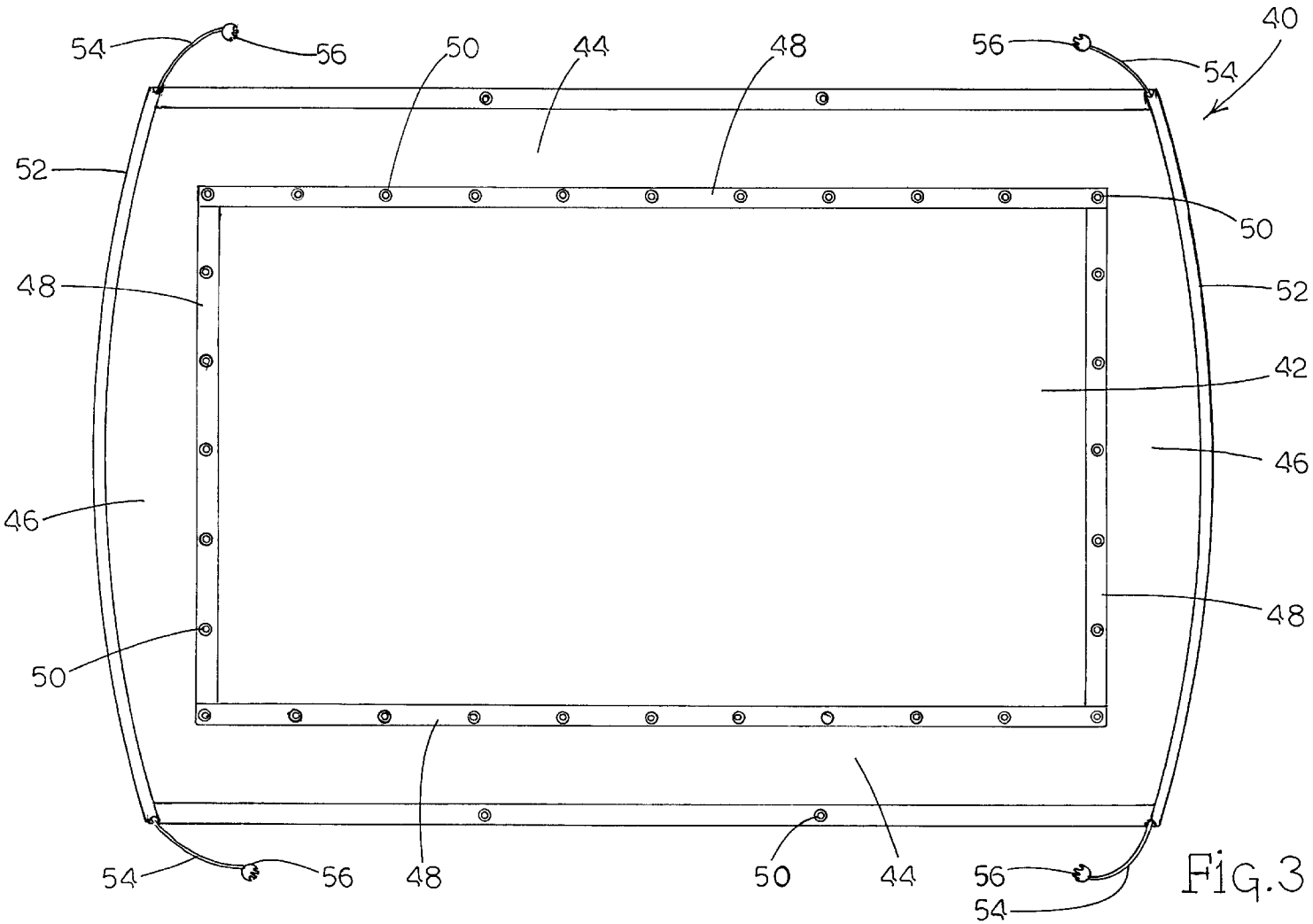
FIG. 3 is a bottom plan view of the cover for the canopy of the present invention.

Shown in FIG. 3 is a bottom view of the canopy covering 40, as the covering would appear if unfolded and laying flat on the ground. From the illustration provided in FIG. 3, it will be appreciated that the covering 40 is generally rectangular in shape, having a pair of end and side edges. The end edges of covering 40 are generally folded back onto the main body of the covering, where they are stitched or otherwise secured so as to effectively form a small, hollow passageway 52 along the edge of each end of the covering 40. Disposed within this edge passageway 52 is a bolt cord or draw cord 54, which is typically elastic in nature. Once threaded within the edge passageway 52, the ends of each elastic bolt cord 54 are fitted with a generally spherical or ball-shaped stopper 56.

The side edges of the covering 40 are also generally folded back onto the main body of the covering, where they are stitched or otherwise secured. However, in this case, the doubling back of material is intended to provide additional strength to the side edges such that each side edge may accommodate a pair of securing or reinforcing grommets 50. Such reinforcing grommets 50 are typically formed of metal and are press fit into apertures formed in the body of the covering 40 so as to provide a high strength, rip resistant attachment point for a securing line or cord.

Inset towards the interior and thus generally away from the edges of the covering 40 are a series of four grommet strips 48. Strips 48 are typically stitched or otherwise secured to the main body of the covering such that each grommet strip 48 is generally parallel to the nearest adjacent edge of the covering 40, as indicated in FIG. 3. Furthermore, each strip 48 includes a series of individual reinforcing grommets 50 which are functionally equivalent to the grommets 50 in the side edges as discussed above. It will be appreciated that the grommet strips 48 are attached or secured to the main body of the canopy 40 in a manner such that one edge of each strip 48 is free. Consequently, when the canopy 40 is unfolded and stretched across the associated frame structure 20, the grommet strips 48 are allowed to hang generally vertically, thus permitting easy access to the securing grommets 50 disposed therein. It will be appreciated that the grommet strips 48 generally define one edge of the top, side and end panels 42, 44 and 46, respectively. Furthermore, it should be noted that while the grommet strips 48 are generally parallel to the edges of the covering 40, the strips 48 that are adjacent the ends of the covering will not be exactly parallel to associated edges. This is the case because the end edges are purposely tapered or contoured so as to provide the end panels 46 with a particular aesthetic or decorative appearance. In the case of the embodiment illustrated in FIG. 1, the end panels 46 are generally tapered in a straight manner, while in the case of the alternate embodiment shown in FIG. 2, the end panels 46 are generally tapered in curved or arched fashion. However, regardless of the particular contour employed, in all cases the grommet strips 48 define the upper edge of each of the protective panels 42, 44, and 46.

Figure 4:
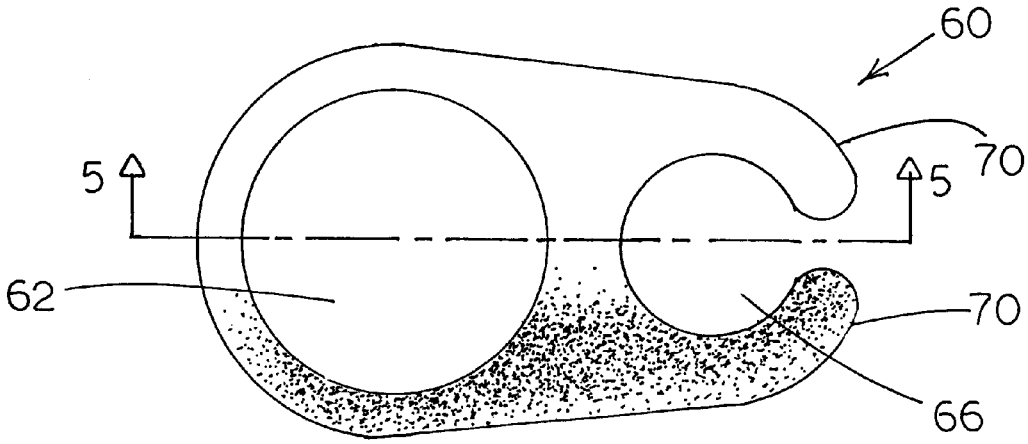
FIG. 4 is a top plan view of a securing tab of the present invention that assists in tying the canopy cover to the frame structure.
Figure 5:
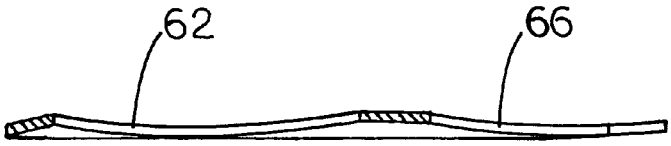
FIG. 5 is a side elevational view of the securing tab.

The canopy structure 10 of the present invention also includes or incorporates a securing tab, generally indicated by the numeral 60, as shown in FIGS. 4 and 5. Tab 60 is typically formed of a metal or metal alloy such as aluminum or stainless steel, but could also be fabricated of a hard rubber or synthetic polymer compound. As such, one end of the securing tab 60 includes a generally circular pole aperture 62, which is of a diameter that is slightly larger than the outer diameter of the associated pole or vertical frame member 22 on which it is to be employed. As such, the tab 60 may be threaded onto an associated frame member 22 by fitting or sliding one end of the frame member 22 through the pole aperture 62. Once threaded onto the frame member 22, the tab 60 is free to slide up and down so long as a generally perpendicular orientation is maintained with respect to the frame member passing therethrough. If, however, the tab 60 becomes significantly tilted or rotated with respect to the frame member 22, the rim or sides of the pole aperture 62 engage the surface of the frame member and effectively bind or lock the tab 60 in place, such that the tab 60 is not able to slide freely up or down the associated vertical frame member 22. On the end of the tab 60 opposite the pole aperture 62 is a generally circular cord aperture 66. Cord aperture 66, while being generally circular, further includes a break or opening that forms a throat area 72 which is bounded on either side by a pair of finger-like projections 70. As such, the finger-like projections 70 and throat area 72 effectively form a slotted entrance or passageway to the interior of the generally circular cord aperture 66.

Figure 7:
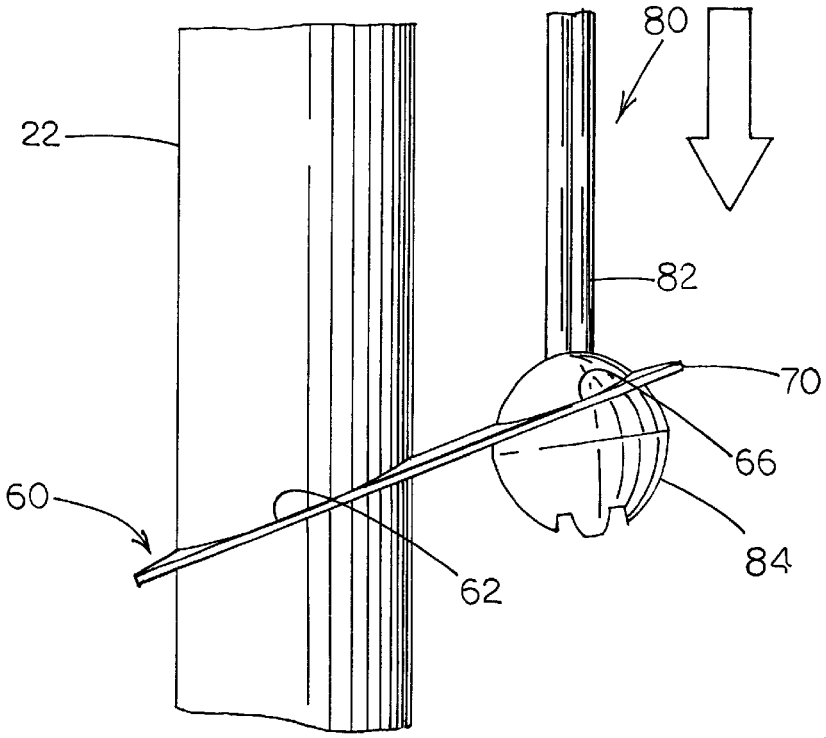
FIG. 7 is a fragmentary, side elevational view of a canopy frame structure member illustrating the securing tab in an engaged or locked configuration.

Adapted to be used in conjunction with the securing tabs 60 and/or the grommets 50 disposed in the canopy covering 40 are securing cords, generally indicated by the numeral 80. Each securing cord 80 is comprised of an elastic band or loop 82 which includes a ball-shaped stopper 84, as shown in FIG. 7.

As mentioned previously, when completely assembled, the various vertical, horizontal, and roof truss support members 22, 24, and 26, respectively, and roof ridge members 27 are joined and linked together using the connectors 28 so as to form the internal frame assembly 20 shown in FIGS. 1 and 2. Furthermore, it will be appreciated that the vertical support members 22, in a fully assembled frame structure 20, are generally disposed such that one end of each vertical member 22 is buried just below the surface of a relatively level area of ground 12. In practice, the buried ends of the vertical members 22 may be additionally set in concrete or cement so as to further secure and stabilize the entire frame assembly 20.

With the internal frame 20 fully assembled, the canopy covering 40 is positioned atop the frame structure 20 with the grommet strips 48 facing down and then extended generally over and around the roof apex members 27 and the roof truss members 26. The grommet strips 48 are subsequently further aligned so as to be immediately adjacent the horizontal support members 24 and the roof truss members 26 located at either end of the frame assembly 20. Being so aligned, the side and end panels 44 and 46, respectively, will necessarily extend beyond the edges of the roof, as defined by the roof truss members 26, and hang generally downwardly towards the ground 12.

With the canopy covering 40 in position and the grommet strips 48 properly aligned with respect to the horizontal and truss support members 24 and 26, respectively, the elastic securing cords 80 may be used to attach the canopy covering 40 to the frame structure 20. More particularly, the elastic securing cords 80 are used to secure all of the grommet reinforced securing points on both the grommet strips 48 and the side panels 44 of the canopy cover 40 to the frame structure 20. In the case of the grommet strips 48, the elastic cord loop 82 is passed through the grommet 50, around the adjacent frame member, and the end of the cord loop 82 is then opened and stretched so as to pass around and over the associated ball-shaped stopper 84. As the stretched elastic cord 82 is released and recoils, the ball-shaped stopper 84 prevents the looped end of the cord 82 from retreating back around the frame member and out through the grommet 50. Thus, the ball-shaped stopper 84 effectively locks the elastic cord loop 82 in place, and in the process generally secures the grommet 50, and necessarily the canopy cover 40, to the frame assembly 20.

Figure 6:
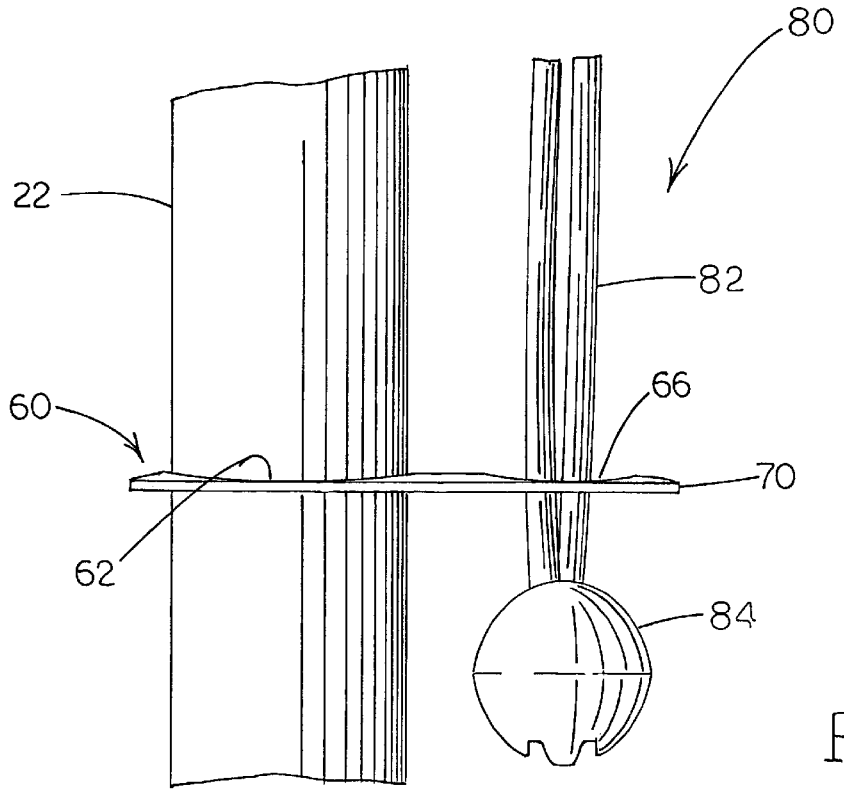
FIG. 6 is a fragmentary, side elevational view of a canopy frame structure member illustrating the securing tab in a disengaged or unlocked configuration.
Figure 8:
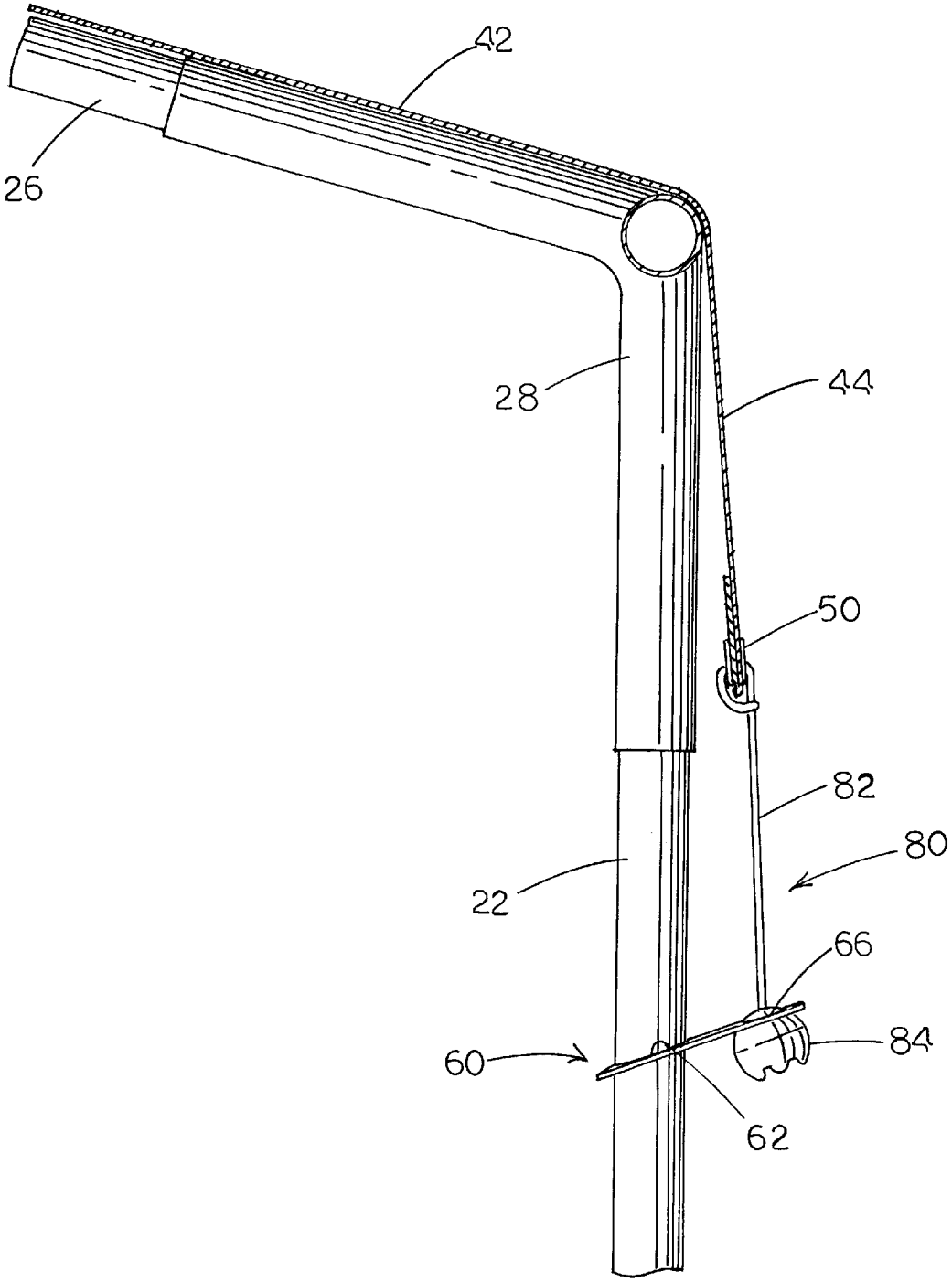
FIG. 8 is a fragmentary, sectional view of the canopy structure illustrating a side wall panel and an associated securing tab.

In the case of the grommet reinforced securing points disposed in the side panel areas 44 of the canopy coveting 40, a securing tab 60 is required in addition to the elastic securing cord 80. As shown in FIG. 8, the securing tab is threaded onto the vertical frame member 22 such that the frame member 22 passes generally through the pole aperture 62. The elastic securing cord 80 is then inserted through the grommet 50 in the same manner as described above. That is, the securing cord loop 82 is passed through the grommet 50 and once through, the end of the cord loop 82 is opened and slipped over the ball-shaped stopper 84 so as to effectively form a slip-type knot configuration. The stopper-end of the cord 80 is then pulled downwardly and taught, which causes the slip-knot feature to slide upwardly and generally tighten around the grommet 50. With tension still on the elastic cord 80, the associated securing tab 60 is slid along the support member 22 into a position which allows the ball-shaped stopper 84 to be slipped just below the tab's lower surface. The cord loop 82 is then permitted to pass between the tab's finger-like projections 70, through the adjacent throat area or passageway 72, and into the cord aperture 66, as indicated in FIG. 6. Once tension is released, elastic cord loop 82 recoils, causing the ball-shaped stopper 84 to move upward and generally engage the cord aperture 66 of the tab 60. As shown in FIG. 7, after engaging the cord aperture feature 66 of the tab 60, the ball-shaped stopper 84 continues to be pulled generally upwardly by the recoiling elastic cord loop 82. The application of an upward force at the cord aperture 66 causes that end of the tab 60 to be tilted or rotated generally upward and in doing so causes the tab 60 to bind against the adjacent vertical support member 22, thus locking the tab 60 in place and preventing any further upwards sliding of the tab 60 on the support member 22, as shown in FIG. 7. Consequently, once the tab 60 is effectively bound against the support member 22, a significant amount of tension is maintained in the stretched elastic securing cord 80, and as such this residual tension is adequate to pull the associated side panel 44 generally downward and maintain the panel 44 in a secured and taught configuration, as indicated in FIG. 8. It will be further appreciated that the tab 60 may be positioned on the vertical support member 22 in such a manner as to receive and secure the associated elastic cord 80 after the cord 80 has been wrapped around the vertical support member 22 any number of times. In this way, a fraction of the elastic cord recoil force may be used to hold the associated side panel 44 firmly against the adjacent horizontal support member 24.

Figure 9:
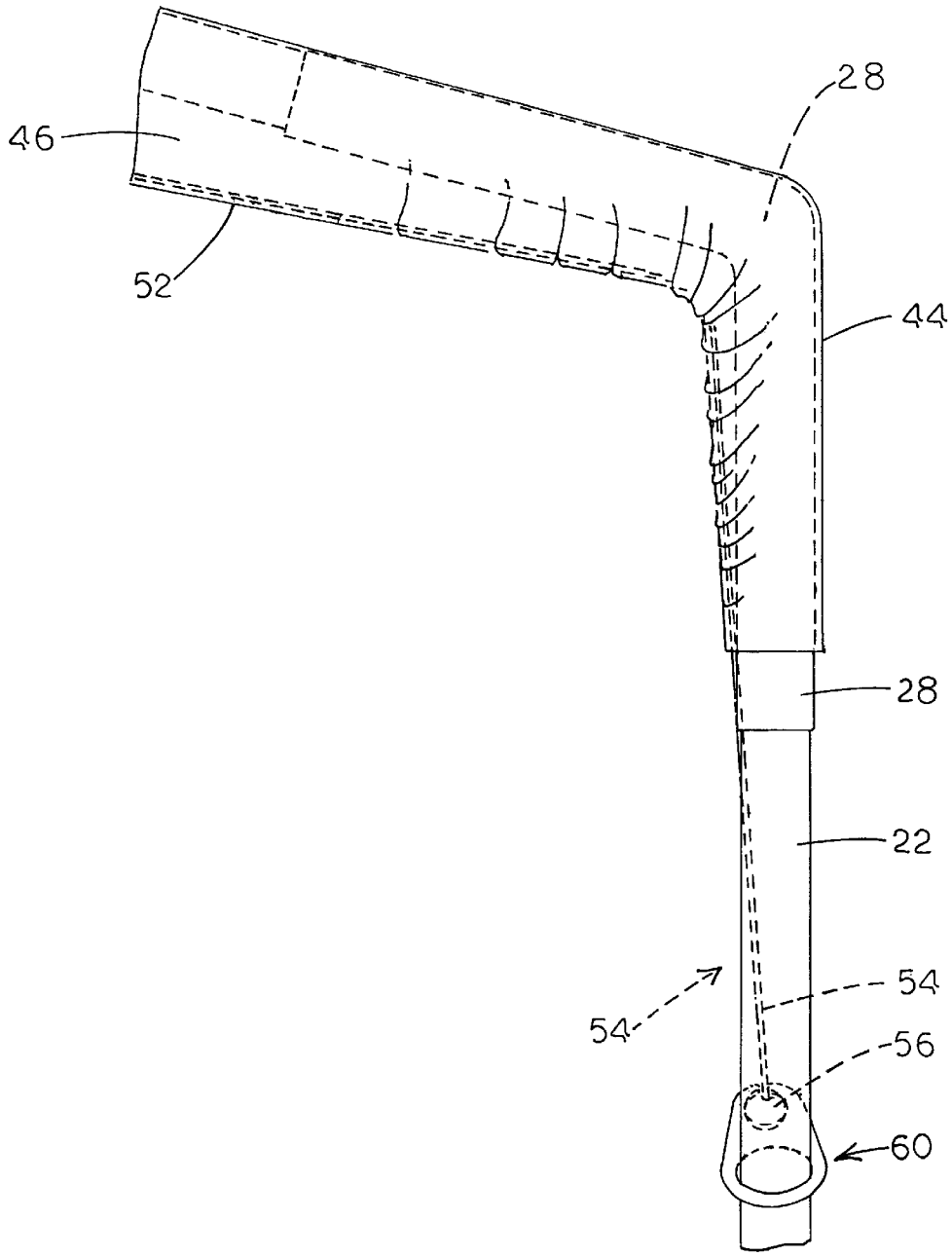
FIG. 9 is a fragmentary, end elevational view of the canopy structure illustrating an end panel and the associated bolt cord and securing tab.

At either end of the canopy structure 10, the elastic bolt cords 54 are secured to the vertical support members 22 of the frame structure 20 in much the same manner as that described above. That is, with a securing tab 60 in place on the associated vertical support member 22, each end of the elastic bolt cord 54 is stretched generally downwardly adjacent the support member 22. With the bolt cord 54 sufficiently stretched or extended, the tab 60 is slid along the support member 22 until the cord aperture 66 is positioned adjacent the ball-shaped stopper 56 located on the end of the cord 54. While tension is maintained in the stretched bolt cord 54, the ball-shaped stopper 56 is slipped just below the lower surface of the adjacent securing tab 60 such that the cord 54 is permitted to pass between the tab's finger-like projections 70, through the adjacent throat area or passageway 72, and into the cord aperture 66. Once tension is released, the elastic cord 54 recoils, causing the ball-shaped stopper 56 to move upward and generally engage the cord aperture 66 of the tab 60. As shown in FIG. 9, after engaging the cord aperture feature 66 of the tab 60, the ball-shaped stopper 56 continues to be pulled generally upwardly by the recoiling elastic bolt cord 54. The application of an upward force at the cord aperture 66 causes that end of the tab 60 to be tilted or rotated generally upward and in doing so causes the tab 60 to bind against the adjacent vertical support member 22, thus preventing any upwards sliding of the tab 60 on the support member 22, as shown in FIG. 9. Consequently, once the tab 60 is effectively bound against and locked in position with respect to the support member 22, a significant amount of tension is maintained in the stretched elastic bolt cord 54, and as such this residual tension is adequate to pull the associated end panel 46 generally downward and maintain the panel 46 in a secured and taught configuration. It will be further appreciated that the tab 60 may be positioned on the vertical support member 22 in such a manner as to receive and secure the elastic bolt cord 54 after the cord 54 has been wrapped or partially twisted around the associated vertical support member 22.

In both the case of the bolt cords 54 and the side panel securing cords 80, the purpose of these elastic cords and the associated securing tabs 60 is to apply and maintain sufficient tension to the edges of the canopy covering 40 so as to insure that the covering 40 is stretched taughtly and held securely in place on the frame 20. As such, the taughtly stretched covering 40 is able to provide the interior of the canopy structure 10 with some degree of protection from the natural elements. Furthermore, by maintaining the covering 40 in a taught configuration, a particular aesthetic form or decorative appearance may be conveyed. In the case of the canopy structure embodiment shown in FIG. 1, a generally angled or pitched straight roof line is formed as a result of the shape of the roof truss members 26 in combination with the contour of the taughtly stretched canopy covering 40. Short, taughtly stretched side panels 44 extend generally downwardly, while the tightly stretched elastic bolt cords 54 insure that the associated end panels 46 are pulled taughtly so as to appear generally straight-line tapered as they extend downward from the roof panel 42. In the case of the canopy structure embodiment shown in FIG. 2, a smoothly curved or arched roof line is formed as a result of the shape of the roof truss members 26 in combination with the contour of the taughtly stretched canopy covering 40. Short, taughtly stretched side panels 44 extend generally downwardly, while the tightly stretched elastic bolt cords 54 insure that the associated end panels 46 are pulled taughtly so as to also present a generally curved or arched appearance as they extend downward from the roof panel 42.

With particular reference to FIG. 9, it is noteworthy to observe how the bolt cord 54 extends closely adjacent the frame structure of the canopy in the corner area. In particular, note that the elastic or bolt cord 54 extends closely adjacent the vertical members 22 of the frame as the bolt cord 54 extends upwardly to the corner connector 28 of the frame structure. This is to be contrasted with cases where the tie down cords would tend to extend at an angle across the corner area. This approach makes it more difficult to effectively secure the tie cord to the frame structure.

Figure 2A:
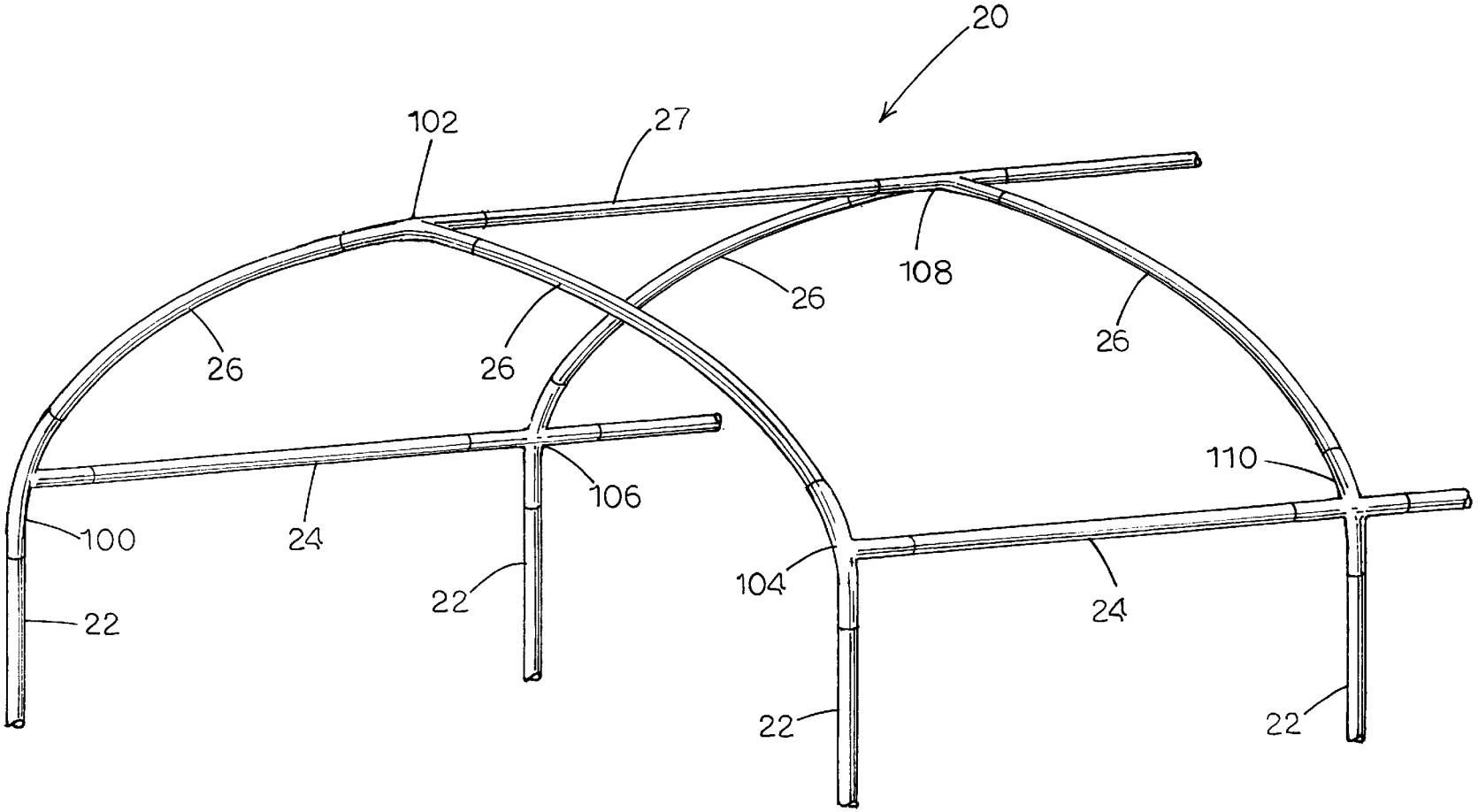
FIG. 2A is a fragmentary perspective view of a main frame structure for a canoe type structure.

Turning to FIG. 2A, there is shown therein an alternate embodiment for the basic frame structure for the canopy of the present invention. In this alternative embodiment, the frame, like that shown in FIGS. 1 and 2, include a series of vertical members 22, a series of truss members 26 and series of ridge members 27. All of these components are connected together by connectors. Disposed on opposite ends of the frame structure, there is provided three connectors referred to by the numerals 100, 102 and 104. Note that each of these connectors includes three arms or fingers that project from a central portion of the connector. Because of the shape of the truss members 26, the three connectors, 100, 102 and 104 can be designed to be identical or interchangeable. Thus connectors 100, 102 and 104 are all interchangeable.

About intermediate portions of the frame structure, there is also provided additional connectors. In this case, as shown in FIG. 2A, note that the connectors 106, 108 and 110 all have four arms or four fingers projecting from the central portion thereof. But again, because of the particular shape of the frame structure and the components thereof such as the tress members 26, all three of these connectors, that is connectors 106, 108 and 110, are identical and interchangeable. This means, that for a basic frame structure of the type shown in FIG. 2A, that only two different types of connectors are required for the entire frame structure of the canopy structure.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended Claims are intended to be embraced therein.

What is claimed is:

1. A canopy structure for providing a protective covering for vehicles, boats and other objects, comprising:

a) a frame structure having a series of posts and a pitched roof structure;

b) a pliable cover for fitting over the frame structure;

c) the pliable cover including at least one end section that, when installed on the frame structure, turns down over one end portion of the pitched roof structure and defines a transversely-extending turned-down end panel that extends across the end of the canopy structure;

d) the turned-down end panel having a terminal edge and an elongated tie cord passageway formed on the end panel and disposed adjacent the terminal edge and which extends across the turned-down end panel;

e) at least one tie cord, having opposite ends, and extending through the tie cord passageway; and f) at least two securing tabs mounted on the frame structure and adapted to be releasably connected to the opposite ends of the tie cord for securing the end panel in a turned-down configuration on the canopy, each of the securing tabs being movably mounted to the frame structure such that the securing tabs may be moved from one point to another on the frame structure.

2. The canopy of claim 1 wherein when the cover is secured to the canopy, the terminal edge of the turned-down end panel is non-linear and extends from a corner portion of the cover generally outwardly and then extends back inwardly to an opposed corner portion of the cover.

3. The canopy of claim 2 wherein the pitched roof includes a ridge and wherein the frame structure includes opposed corners, and wherein the width of the turned-down panel is a maximum adjacent the ridge and becomes progressively narrower toward the opposed corners.

4. The canopy of claim 1 wherein the width of the end panel progressively increases from one corner area of the canopy to an intermediate area of the turned-down end panel and then progressively decreases in width from the intermediate area of end panel to the other corner area of the canopy.

5. The canopy of claim 1 wherein the pliable cover includes two turned-down end panels and wherein the terminal edge of each of the turned-down end panels assumes a generally curved configuration.

6. The canopy of claim 1 wherein the tie cord passageway assumes a generally curved shape, and wherein the tie cord passageway includes a pair of open ends through which the tie cord extends.

7. The canopy of claim 1 wherein when the canopy is erected, the frame structure of the canopy includes a series of corners, each corner formed by connecting one post with a member of the pitched roof frame structure, and wherein there is an angle formed between the post and the member of the pitched roof frame structure; and wherein the turned-down end panel is constructed to generally conform to the angle formed by the post and the member of the pitched roof frame structure.

8. The canopy of claim 1 wherein an angle is formed by a connector interconnecting the post with a member of the pitched roof frame structure and wherein the angle formed is greater than 90°, and wherein the cord passageway and tie cord extending through the cord passageway extend around the formed angle such that the tie cord and tie cord passageway lie closely adjacent to the connector.

9. A canopy structure for providing a protective covering for vehicles, boats, and other objects, comprising:

a) a frame structure having a series of posts and a pitched roof structure;

b) a pliable cover for fitting over the frame structure;

c) the pliable cover including at least one end section that, when installed on the frame structure, turns down over one end portion of the pitched roof structure and defines a transversely extending turned-down end panel that extends across the end of the canopy structure;

d) the turned-down end panel having a terminal edge and an elongated tie cord passageway formed on the end panel and disposed adjacent the terminal edge and which extends across the turned-down end panel;

e) wherein the tie cord passageway extends continuously across the turned-down end panel;

f) a tie cord extending through the tie end passage way and including opposed end portions that may be secured so as to maintain the end section in a turned-down configuration about the frame structure of the canopy; and g) where the frame structure includes at least two corners and wherein the end panel, when turned down, extends from one corner to another corner, wherein the width of the end panel as turned down increases from one corner to an intermediate area between the corners and then decreases from the intermediate area to the other corner such that the intermediate area of the turned-down end panel has a width greater than the width of the turned down end panel adjacent the corners.

10. The canopy structure of claim 9 wherein the pliable cover includes two turned-down end panels and wherein the terminal edge of each of the turned-down end panels assumes a generally curved configuration.

11. The canopy structure of claim 9 wherein the pitched roof includes a ridge and wherein the width of the turned-down panel is a maximum adjacent the ridge and becomes progressively narrower towards the opposed corners.

* * * * *